US005720840A

United States Patent [19]

Tahon et al.

[11] Patent Number: 5,720,840

[45] Date of Patent: Feb. 24, 1998

[54] METHOD FOR APPLYING A HYDROPHILIC COLLOID LAYER ON A NAKED GLASS SUPPORT

[75] Inventors: Jean-Pierre Tahon, Leuven; Bartholomeus Verlinden, Tongeren; Bart Ramandt, Brugge, all of Belgium

[73] Assignee: AGFA-Gevaert, N.V., Mortsel, Belgium

[21] Appl. No.: 679,244

[22] Filed: Jul. 12, 1996

[30] Foreign Application Priority Data

Jul. 14, 1995 [EP] European Pat. Off. ..... 95201940

[51] Int. Cl.[6] ..... B44C 1/165

[52] U.S. Cl. ..... 156/230; 156/231; 156/236; 156/241; 156/247

[58] Field of Search ..... 156/230, 231, 156/236, 241, 247

[56] References Cited

U.S. PATENT DOCUMENTS

| | | | |
|---|---|---|---|
| 3,642,474 | 2/1972 | Verelst et al. | 96/30 |
| 3,661,584 | 5/1972 | Van Den Heuvel et al. . | |
| 4,312,941 | 1/1982 | Scharf et al. | 430/510 |
| 4,701,401 | 10/1987 | Leenders et al. | 430/257 |
| 5,254,447 | 10/1993 | Meyer et al. | 430/510 |

FOREIGN PATENT DOCUMENTS

| | | |
|---|---|---|
| 0529697 | 3/1993 | European Pat. Off. . |
| 60-43314 | 2/1994 | Japan . |

OTHER PUBLICATIONS

Patent Abstract SU–A 1,090,149, Jan. 1994, Dubrovin et al.

*Primary Examiner*—Erma Cameron
*Attorney, Agent, or Firm*—Breiner & Breiner

[57] ABSTRACT

A method is provided for applying any hydrophilic colloid layer on a naked glass support comprising the steps of (i) wetting a naked glass support, with a polar solvent comprising more than 1% water, (ii) applying the hydrophilic colloid layer, provided on a temporary support, onto the wet glass support, so that the hydrophilic colloid layer is in direct contact with the wetted glass and (iii) stripping the temporary support away.

It is preferred that the wetting solution comprises an organic silicon compound. The method is especially suited for applying photographic layers on a naked glass support. By using this method no special adhesive layer is needed and all photographic properties are kept unimpaired.

12 Claims, No Drawings

METHOD FOR APPLYING A HYDROPHILIC COLLOID LAYER ON A NAKED GLASS SUPPORT

FIELD OF THE INVENTION

This invention relates to a process for applying layers on a naked glass support. In particular this invention relates to silver halide photographic materials applied by lamination onto a glass support.

BACKGROUND OF THE INVENTION

For many applications of silver halide photographic materials, dimensional stability is of utmost importance. Although polyester based plastic films can be used to produce photographic materials showing good dimensional stability, it is for speciality applications, e.g. photomicrography, some graphic arts application, photofabrication of PCB (printed circuit boards), etc., still preferred to use silver halide photographic materials coated on glass. Also in application where the material has to have high thermal stability, the use of a glass support is preferred over the use of a plastic film support. An example of an application where high thermal stability is needed is the manufacture of LCD's as described in EP-B 396 824 and EP-A 615 161. In the manufacture of colour filters for the production of colour LCD's the optical isotropy of glass (most polymer films are optically anisotropic, i.e. show birefringence) is an advantage.

Coating silver halide emulsions on glass plates is not a straightforward operation. The difficulties are enumerated in various documents, U.S. Pat. No. 4,033,290, U.S. Pat. No. 5,254,447 being of the most explicit.

The main problem in coating glass plates is the fact that it is a discontinuous process. In such a process the glass plates advance one after another underneath a coating device. When the coating device dispenses continuously coating liquids, the leading and trailing end of each glass plate is coated, but there is a great risk of coating liquids reaching the side of the glass plate were no coating liquid should adhere to the plate. This phenomenon is known as "backside smearing". In Research Disclosure no 19918, of November 1980 it has been disclosed to provide a resilient hydrophobic bead between the adjacent rear and front faces (edges) of the glass plates, to avoid "back smearing". In U.S. Pat. No. 5,143,759 a system to overcome the cited problems is disclosed. It comprises using a liquid feeder having an elastic flexible hanger fitted to its bottom, and control means for keeping a glass plate and the hanger out of contact until the leading edge of the plate passes under the hanger, for putting plate and hanger in contact with each other after the leading edge of the plate has passed under the hanger so that coating is started, and putting plate and hanger out of contact immediately before the liquid is applied to the plate at the trailing edge thereof. This method leaves the leading and trailing margin of a glass plate uncoated and avoid "backside smearing", but requires delicate control of contact and no-contact of the hanger with the glass plates. Further, it easily causes bands and streaks, in particular if the rearside of the hanger becomes soiled. To avoid "backside-smearing" the glass plates are, during the coating process, only supported on the edges. This limits the width of the plates and the thickness of the plates that can be coated in a discontinuous process because wide and thin glass plates that are only supported by the edges bend in the middle and can not easily be coated uniformly. It is possible to design means for supporting thin glass during coating so that the bending in the middle of the glass is avoided (e.g. a supplemental supporting member in the middle of the glass, a full surface support, etc.). The implementation of these additional supporting means in a glass coating machine, however increase the problems for avoiding "backside smearing".

It has been proposed, to overcome the problems cited above, to laminate silver halide photographic materials, coated on conventional plastic film, on to the glass plates and adhere the material on the glass plate by an adhesive layer. This adhesive layer may be present on the backside of the plastic film support and in that case the film support is still present in the final product. Lamination can also proceed via an adhesive layer provided on the silver halide emulsion and after lamination the plastic film support can be stripped away. Such a process is described in e.g. U.S. Pat. No. 5,254,447, wherein in the adhesive layer heat curable or pressure sensitive adhesive compounds are used, and wherein preference is given to the latter.

In Japanese Laid Open Application JP-A 06/043314 lamination of a colour image formed in a photopolymer layer on glass has been proposed. In that disclosure the glass is pre-treated with silane components and then washed to remove the excess of silane coupling agent and then dried. Afterwards the glass is heat treated in a convection oven. The photopolymer layer is laminated to the glass plate off-line.

Lamination of silver halide photographic materials via an adhesive layer onto glass plates bring about problems in applying an adhesive layer onto the silver halide emulsion layer, in protecting said layer before the lamination by an eventual application of a release foil, in choosing a non colouring adhesive, possible interaction of components of the adhesive layer with photosensitivity of the photographic material, etc.

There is thus still need to have the possibility of laminating silver halide materials onto a naked glass support and permanently fixing said photographic material onto the support, without the need of a special adhesive between the glass support and the hydrophilic colloid layers of the silver halide material. The need for having such a possibility in an on-line method starting from dry naked glass and ending in one pass to a photographic material on a glass support is also still there.

OBJECTS AND SUMMARY OF THE INVENTION

It is an object of the invention to provide hydrophilic colloid layers, especially but not exclusively, silver halide photographic layers on a glass support.

It is a further object of the invention to provide a method for laminating hydrophilic colloid layers, especially but not exclusively, silver halide photographic layers onto a naked glass support, without the need of special adhesive layers.

It is an other object of the invention to provide the possibility of having an on-line method for laminating hydrophilic colloid layers, especially but not exclusively, silver halide photographic layers onto a glass support, starting from dry naked glass and ending in one pass to a photographic material on a glass support, wherein, between the glass support and the hydrophilic colloid layers of the silver halide material, no special adhesive layer is present.

It is an other object of the invention to provide a method for laminating unexposed or exposed silver halide photographic layers onto a glass support, without deterioration of the photographic properties (speed, fog, sharpness, noise, etc) of the laminated silver halide photographic layers, so that after exposure high quality image can still be formed.

It is still a further object of the invention to provide a method for laminating colour photographic layers onto a glass support that leaves not only the basic photographic properties of the material unimpaired, but also the fidelity of colour reproduction.

Further objects and advantages of the invention will become clear from the detailed description hereinafter.

The objects of the invention are realized by providing a method for applying any hydrophilic colloid layer on a naked glass support comprising the steps of:

(i) wetting a naked glass support, with a polar solvent comprising more than 1% water, (ii) applying said hydrophilic colloid layer, that is provided on a temporary support, onto said wet naked glass support so that said hydrophilic colloid layer is in direct contact with said wetted glass and (iii) stripping said temporary support away.

In a preferred embodiment said hydrophilic colloid layer is part of a silver halide photographic material.

In a further preferred embodiment said hydrophilic colloid layer comprises a proteinaceous colloid and said naked glass support is wetted with a solution comprising an organic silicon compound, comprising a silicon portion having affinity for glass and an organic portion that is tailored to match the reactivity of said proteinaceous colloid.

DETAILED DESCRIPTION OF THE INVENTION

The main advantages of glass as a support for any layer is the dimensional stability of the glass support and the recyclability, the main drawback is the weight of the glass support. Therefore, in many applications, the trend exists to use thinner glass supports to keep the dimensional stability, but to lower the weight of the finished product. The need for glass supports with thickness under 1.2 mm is not uncommon. E.g. in the manufacture of LCD the use of glass supports as thin as 0.7 mm or less is advisable. Especially in this segment, the use of even thinner glass supports is highly desired, both for economical reasons and reasons of weight.

The problems of coating one or more layers on glass supports as thin as or thinner than 0.7 mm in a discontinuous coating process are even more severe than problems associated with the discontinuous coating on thicker glass supports, because wide and thin glass plates that are only supported by the edges (as is done in a discontinuous process for coating glass plates) bend in the middle and can not easily be coated uniformly.

It has now been found that it is possible to apply hydrophilic colloid layers onto a glass support, even on these very thin glass supports, by laminating said layers onto a wetted naked glass support starting from an intermediate element in which said hydrophilic layer(s) have been applied in a continuous way on a temporary support. A "naked" glass support means hereinafter a glass support on which no special adhesive layer, especially no adhesive layer comprising heat curable or pressure sensitive adhesive compounds, is present. When laminating said layers onto a wetted naked glass support, it is no longer necessary to have special adhesive layers present either on top of the hydrophilic colloid layer nor on the glass support. The absence of adhesive layers, that usually comprise heat curable or pressure sensitive adhesive as, e.g., film forming copolymers of methyl vinyl ether and maleic anhydride that have been described in U.S. Pat. No. 5,254,447, has the advantage that an eventual yellowing of said adhesive layer during storage or upon heating of the finished material is avoided. The presence of adhesive layers limits also the possibility for use of photographic materials on glass support in those applications where the material has to withstand high temperature treatment, because of the possible deterioration of the adhesive qualities of said layers due to the heat treatment. Since in the method according to the present invention the hydrophilic layer is laminated to said naked glass support so that the hydrophilic layer is in direct contact with the glass support, there is also no need to have an adhesive layer on top of the hydrophilic layer that will be laminated to the glass support. Therefore, when a photographic material is applied to a glass support by a method according to the present invention, no adhesive layers, that usually comprise heat curable or pressure sensitive adhesive as, e.g., film forming copolymers of methyl vinyl ether and maleic anhydride that have been described in U.S. Pat. No. 5,254,447, are present in the photographic material on the glass support. This makes the method especially well suited for the production of photographic materials on glass support that have to withstand yellowing during storage or upon heating of the finished material. Thus this method is especially well suited for the production of photographic materials on glass support for use in the production of colour filters for LCD's.

The method, according to one embodiment of the invention, for laminating at least one hydrophilic colloid layer to a naked glass support comprises two phases:

Phase I, comprising the step of applying at least one hydrophilic layer onto a temporary support, forming an intermediate element Phase II, comprising the steps of:

(i) wetting a naked glass support, with a polar solvent comprising more than 1% water, (ii) applying said intermediate element onto said wetted glass support with said hydrophilic colloid layer(s) closest to said glass support, in such a way that said at least one hydrophilic colloid layer is comprised between said glass support and said temporary support, forming a complex structure, (iii) stripping said temporary support away.

It is possible to practice phase I and phase II immediately one after another or there may be a lapse of time between phase I and phase II.

In an other embodiment of the invention, the method comprises three phases:

Phase I, comprising the step of applying at least one hydrophilic layer onto a temporary support, forming an intermediate element; Phase II, comprising the steps of:

(i) wetting a naked glass support with a wetting solution comprising an organic silicon compound that comprises a silicon portion having affinity for glass and an organic portion that is tailored to match the reactivity of the hydrophilic colloid, (ii) drying said support at temperatures above 50° C., thus giving a pre-treated glass support;

Phase III, comprising the steps of:

(i) wetting said pre-treated glass support with, with a polar solvent comprising more than 1% by volume of water, (ii) applying said intermediate element onto said wetted glass support with said hydrophilic colloid layer(s) closest to said glass support, forming a complex structure, (iii) stripping said temporary support away.

Phase I and II can be executed separately from phase III or it is possible that phase II is practised separately and that phase I and III can be practised at the same time.

In all embodiments of the invention it is possible to heat the material either before or after the temporary support is stripped away. It has been found to be beneficial to condition said material once the temporary support is stripped away for between 1 and 5 days at a temperature between 15° and 35° C. at a relative humidity (RH) between 70 and 90%.

The Wetting Solution

The wetting of the naked glass support can proceed with any polar solvent. It can be wetted with water, lower aliphatic alcohols, ketones, dioxane, etc. When wetting the naked glass support with a polar solvent other than water, it is necessary that more than 1% by volume of water is present in the wetting solution. It is preferred to wet the naked glass support with either ethanol or methanol, comprising more than 1% by volume of water. A highly useful polar solvent for the wetting solution is a mixture of between 80 and 98% by volume of ethanol and between 20 and 2% by volume of water. The wetting solution can comprise surface active compounds. Anionic as well as non-ionic wetting agents are suited therefor. As examples can be mentioned alkyl- and aryl sulphonates such as dodecylsulphonic acid Na-salt, the N-methyl taurinate product with oleic acid (HOSTAPON T) and sulphonated dodecylphenyl phenyl ethers (Dow FAX 2A1, trade name of DOW Chemical, USA), alkyl- and aryl sulphates such as the sodium sulphate of oxethylated nonylphenol (HOSTAPAL B), poly(vinyl alcohol), oxethylated phenols, oleyl alcohol polyglycol ethers, oxethylated polypropylene glycol, etc.

The hydrophilic colloid layer, to be laminated onto a glass support by the method according to the present invention, comprises preferably a proteinaceous colloid and the wetting of the naked glass support proceeds most preferably by a solution comprising an organic silicon compound. Said organic silicon compound comprises a silicon portion having affinity for glass and an organic portion that is tailored to match the reactivity of the hydrophilic colloid (preferably a proteinaceous colloid). In this way the organic silicon compound realizes a stable bond between the glass support and the hydrophilic colloid (preferably a proteinaceous colloid) layer.

Representative examples of silicon compounds particularly suitable for use according to the present invention are those corresponding to the following formula:

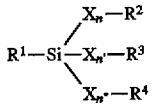

wherein:

X stands for oxygen or —O—CO—, each of $R^1$, $R^2$, $R^3$ and $R^4$ (the same or different) stands for a hydrocarbon group such as alkyl and aryl including a substituted hydrocarbon, at least one of said hydrocarbon groups comprising a group or atom that has a chemical affinity for proteinaceous colloids or that can be cross-linked to free reactive groups, present in said proteinaeeous colloids, through the intermediary of a cross-linking agent, more particularly a hardening agent commonly used for hardening proteinaceous colloids, and each of n, n' and n" (the same or different) stands for 0 or 1, n+n'+n" being at least equal to 1.

When n+n'+n"=1, at least one of said hydrocarbon groups directly connected to the Si atom comprises a group or atom that has a chemical affinity for proteinaceous colloids or that can be cross-linked to the said free reactive groups, present in said proteinaceous colloids, through the intermediary of a cross-linking agent, more particularly a hardening agent commonly used for hardening proteinaceous colloids.

In a preferred embodiment n+n'+n"=3 and $R^1$ comprises a group or atom that has a chemical affinity for proteinaceous colloids or that can be cross-linked to the said free reactive groups, present in said proteinaceous colloids, through the intermediary of a cross-linking agent, more particularly a hardening agent commonly used for hardening proteinaceous colloids.

The following compounds are representative, but not limitative, examples of organic silicon compounds suitable for use according to the present invention:

1

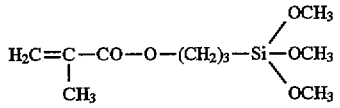

2

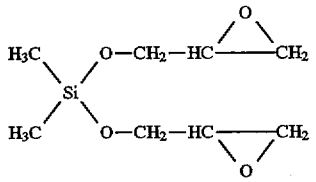

3

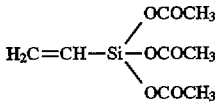

4

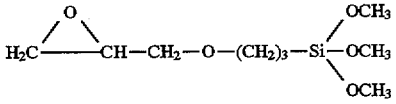

5

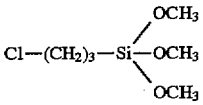

6

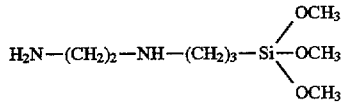

7

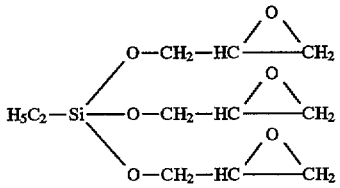

8

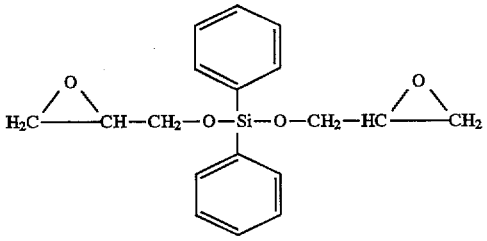

9

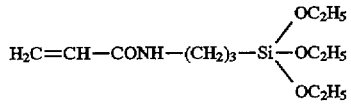

-continued

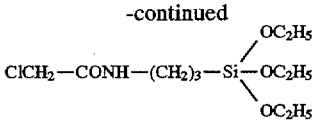

11

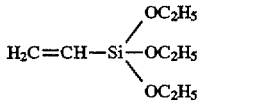

12

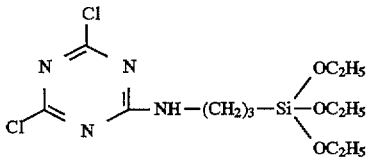

Compounds 1, 3, 4, 5 and 6 are marketed by the Dow Corning Corp., Michigan, USA under the trade-names Dow Corning Z-6030 silane, Z-6075 silane, Z-6040 silane, Z-8-0999 silane and Z-6020 silane respectively.

Compound 11, vinyl triethoxy silane is commercially available from Pierce Chemical Comp., Rockford, Ill., USA The other compounds can be prepared as follows.

COMPOUND 2

A solution of 30.3 g (0.3 mole) of triethylamine in 50 ccs of anhydrous dioxan was added at room temperature to a solution of 22.2 g (0.3 mole) of 2,3-epoxypropanol in 200 ccs of anhydrous dioxan. A solution of 19.3 g (0.15 mole) of dichlorodimethylsilane in 150 ccs of anhydrous dioxan was then added dropwise in 30 minutes. Triethylammonium chloride precipitated immediately and after having been kept at room temperature for 2 days the mixture was filtered with suction. The dioxan solution was concentrated by evaporation and the remaining oil was distilled in vacuo on a water bath.

Boiling point: 84° C./0.05 mm Hg.

COMPOUND 7

This compound was prepared in an analogous way as compound 2 with the difference, however, that 16.3 g (0.1 mole) of trichloromonoethylsilane were used instead of 19.3 g (0.15 mole) of dichlorodimethylsilane.

Boiling point: 138° C./0.5 mm Hg.

COMPOUND 8

This compound was prepared in an analogous way as compound 2 with the difference, however, that 29.4 g (0.4 mole) of 2,3-epoxypropanol were used instead of 22.2 g (0.3 mole), 40.4 g (0.4 mole) of triethylamine were used instead of 30.3 g (0.3 mole) and 50.6 g (0.2 mole) of dichlorodiphenylsilane were used instead of 19.3 g (0.15 mole) of dichloro-dimethylsilane.

Boiling point: 184° C./0.4 mm Hg.

COMPOUND 9

To a solution of 66.3 g of aminopropyl triethoxy silane in 200 ccs of ether, a solution of 13.6 g of acryloyl chloride in 100 ccs of ether was added dropwise at 0° C. The white precipitate of aminopropyl triethoxy silane hydrochloride formed was filtered off by suction whereupon the ether filtrate was concentrated by evaporation and the residue was distilled.

Boiling point: 137° C./0.7 mmHg.

COMPOUND 10

To a solution of 17 g of chloroacetyl chloride in 150 ccs of ether, a solution of 66.3 g of aminopropyl triethoxy silane in 200 ccs of ether was added dropwise at −10° C. The mixture was stirred for 3 hours at −10° C. whereupon the white precipitate of aminopropyl triethoxy silane hydrochloride was filtered off by suction. The ether filtrate was concentrated by evaporation and the residue was distilled.

Boiling point: 138° C./0.4 mm Hg.

COMPOUND 12

To a solution of 27 g of cyanogenchloride in 200 ccs of dioxan, a solution of 33 g of aminopropyl triethoxy silane and 15.1 g of triethylamine in 200 ccs of dioxan was added dropwise in 45 minutes at 10 ° C. The suspension was stirred at room temperature for 4 hours and the triethylamine hydrochloride formed was filtered off by suction. The dioxan solution was then concentrated by evaporation.

The most preferred siloxane compounds, for use in a method according to the present invention, are siloxanes carrying an epoxy group, the most preferred being compound 4

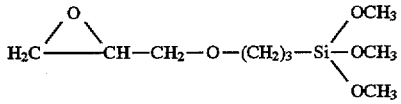

The solvent used to form the wetting solution comprising an organic silicon compound is also preferably a polar solvent. It is possible to wet the naked glass support with a solution, comprising an organic silicon compound that comprises a silicon portion having affinity for glass and an organic portion that is tailored to match the reactivity of the hydrophilic colloid (preferably a proteinaceous colloid), either just before bringing the hydrophilic colloid layer in contact with the wetted glass support, or the naked glass support can be wetted with said solution, dried and after a lapse of time be wetted again with a polar solvent, comprising more than. 1% by volume of water, at the very moment that the hydrophilic colloid layer is brought in contact with the wetted glass support.

The choice of the solvent used to dissolve the silicon containing compound, depends on the moment of wetting the naked glass support. When the wetting proceeds just before contacting naked glass support and hydrophilic colloid layer it is preferred that the solvent is a polar organic solvent, comprising more than 1% by volume of water, e.g. dioxane, tetrahydrofuran, acetone, ethylmethylketone, lower aliphatic alcohols, etc. From these solvents lower aliphatic alcohols are preferred, especially preferred are methanol and ethanol. When the wetting proceeds well before contacting naked glass support and hydrophilic colloid layer the polar solvent can be water or a mixture of water and an organic polar solvent as described above. A highly useful polar solvent for the wetting solution is a mixture of between 80 and 98% of ethanol and between 20 and 2% of water.

The wetting solution comprises preferably between 1 and 10% by weight of organic'silicone compounds, more preferably between 3 and 8% by weight. The wetting solution is preferably applied to the naked glass support such that between 50 mg and 3 g of organic silicon compound are present per $m^2$, most preferably between 0.1 and 2 g of organic silicon compound are present per $m^2$.

Also the wetting solution, comprising silicone compounds as described above, may further comprise wetting agents. The same wetting agents as describe herein above can be used.

It is possible to add hardening agents, known in the art as suitable for hardening hydrophilic colloids (proteinaceous colloids), to the wetting solutions. Typical hardening agents are, e.g., formaldehyde and divinylsulphones.

The wetting solution can be applied to the naked glass support by any technique. It can be sprayed on the support, or coated with the coating techniques known in the art e.g. dip coating, rod coating, blade coating, air knife coating, gravure coating, reverse roll coating, extrusion coating, slide coating and curtain coating. An overview of these coating techniques can be found in the book "Modern Coating and Drying Technology", Edward Cohen and Edgar B. Gutoff Editors, VCH publishers, Inc, New York, N.Y., 1992.

The Hydrophilic Colloid Layers

The hydrophilic colloid layers, applied to a glass support by a method according to the present invention, can be any layer comprising a proteinaceous colloid, preferably gelatin. Together with gelatin the layers may comprises other hydrophilic colloids known in the art, e.g. dextrans, polyamides, polyvinylalcohol, cellulose derivatives, polyvinylpyrollidone, synthetic clays, etc.

The hydrophilic colloid layers are preferably part of silver halide photographic materials. The silver halide photographic materials, that can be applied to a glass support by a method according to the present invention, can be of any type known in the art, e.g. black and white materials, colour materials, materials designed for use in graphic arts, printing plates, materials for use in medical diagnosis, motion picture materials, diffusion transfer materials (both the emulsion layers and the acceptor layer comprising nucleation nuclei), in a dye diffusion transfer process operating with silver halide emulsion layers, etc. The principles and embodiments of silver image formation by DTR-photography are described e.g. by André Rott and Edith Weyde in the book "Photographic Silver Halide Diffusion Processes"—The Focal Press London and New York (1972), and the principles and embodiments of the production of colour images by dye diffusion transfer are described e.g. by C. Van de Sande in Angew. Chem. Int. Ed. Engl. 22, (1983) p. 191–209.

The hydrophilic colloid layers can also be subbing layers, antihalation layers, etc. Preferably the layers, applied to a glass support by a method according to the present invention, form a silver halide photographic material and can comprise any layers know in the art of producing silver halide photographic materials. Such layers are a.o. antihalation layers, intermediate layers, silver halide emulsion layers, protective layers, antistatic layers. The silver halide emulsion layers can comprise a single layer of a silver halide emulsion, or multiple layers of the same or different silver halide emulsions.

The silver halide emulsions used in the photographic materials applied to a glass support by a method according to the present invention can comprise any type of photosensitive silver halide, e.g. silver bromide, silver chloride, silver clearheaded, silver bromoiodide or silver chlorobromoiodide or mixtures thereof. The average particle size is preferably in the range of 0.01 to 1.2 μm. The size distribution of the silver halide particles can be homodisperse or heterodisperse.

The crystal habit of the silver halide particles used in silver halide photographic materials applied to a glass support, according to the present invention, can be of any type known in the art. The silver halide particles can have a pure cubic or octahedral habit without twin planes. They can also have a mixed cubic/octahedral habit without twin planes. The silver halide crystal particles used in emulsion layers can also contain one or more twin planes, can be tabular as disclosed e.g. in DE 32 41 634 and DE 32 41 640 etc..

The light-sensitive silver halide emulsions can be chemically sensitized as described e.g. by P. Glafkidès in "Chimie et Physique Photographique", Paul Montel, Paris (1987), by G. F. Duffin in "Photographic Emulsion Chemistry", The Focal Press, London (1966), and by V. L. Zelikman et al in "Making and Coating Photographic Emulsion", The Focal Press, London (1966), and in "Die Grundlagen der Photographischen Prozesse mit Silberhalogeniden" edited by H. Frieser and published by Akademische Verlagsgesellschaft (1968). The light-sensitive silver halide emulsions, applied to a glass support by a method according to the present invention, can be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. However in the particular case of a contact daylight material the emulsion is preferably not spectrally sensitized in view of the daylight stability.

The silver halide emulsion(s), applied on glass supports by a method according to the present invention, may be direct positive emulsions, either of the internally desensitized type or of the externally desensitized type comprising spectral desensitizers, e.g. pinakryptol yellow, etc.

Said silver halide emulsion(s) may comprise compounds preventing the formation of fog or stabilizing the photographic characteristics during the production or storage of photographic elements or during the photographic treatment thereof. Many known compounds can be added as fog-inhibiting agent or stabilizer to the silver halide emulsion.

The photographic material, applied on a glass support by a method according to the present invention, may further comprise various kinds of surface-active agents in the photographic emulsion layer or in another hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy-, sulpho-, phospho-, sulphuric- or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration. Preferred surface-active coating agents are compounds containing perfluorinated alkyl groups.

Colour photographic recording materials, applied on a glass support by a method according to the present invention, normally comprise at least one silver halide emulsion layer unit for recording light of each of the three spectral regions red, green and blue. For various possible embodiments of colour materials, that can be laminated on a glass support bt a method according to the present invention, reference is made to Research Disclosure December 1989, n° 308119 paragraph VII, which is incorporated by reference.

The hydrophilic colloid layers to be applied to a glass support by a method according to the present invention are applied (coated) on a temporary support to form an intermediate photographic element. After applying the photographic material to a glass support by a method according to the present invention, the uppermost layer (i.e. the layer most distant from the temporary support) of said intermediate element becomes the layers attached to the support in the final photographic element on the glass support. Therefore it is necessary that, in the production of a multilayered intermediate photographic element, useful for laminating photographic materials to the a glass support by a method according to the present invention, the sequence of the layers is reversed with respect to the sequence the photographic material is intended to have on the final glass support. E.g. where in a final photographic material an AHU (antihalation undercoat), comprising anti-halation dyes and/or pigments, is desired to be closest to the support and a protective layer to be an outermost layer, it is necessary in the intermediate photographic element, useful in a method according to the present invention, to coat said AHU as outermost layer and said protective layer closest to the support.

The method according to the present invention is especially useful for applying a colour photographic material on to a glass support, especially when this colour photographic material is intended for the production of colour filters for LCD's. Such a method for the production of colour filters for LCD's comprises in consecutive order the steps of:

(1) providing a photographic print material that contains on a glass support a plurality of differently spectrally sensitive silver halide emulsion layers, (2) subjecting said print material to a single step multicolour pixelwise exposure, (3) colour processing said exposed print material producing thereby in each silver halide emulsion layer a differently coloured pixel pattern, (4) coating said colour processed print material at its silver halide emulsion layer assemblage side with a hydrophobic water-impermeable organic resin layer, to form a water-impermeable covering layer, which covering layer for curing purposes has been thermally treated at a temperature in the range of 50° to 200° C., and (5) depositing by vacuum-coating one of said electrodes on said organic resin layer serving as a covering layer for said silver halide emulsion layer assemblage.

Since in a material applied to a glass support by a method according to the present invention no adhesive layers are present, the risk of yellowing of said adhesive layer during the heat treatment in step 4 of the method for making colour filters for LCD's is avoided.

The Temporary Support

The temporary support for use in the intermediate photographic element to be used in a method according to this invention can be any polymeric support known and commonly employed in the art. They include, e.g. those supports used in the manufacture of photographic films including cellulose acetate propionate or cellulose acetate butyrate, polyesters such as poly(ethyleneterephthalate), polyamides, polycarbonates, polyimides, polyolefins, poly(vinyl acetals), polyethers and polysulfonamides.

Polyester film supports and especially poly(ethylene terephthalate) are preferred as temporary support for the image-recording member according to the present invention, because of their excellent properties of dimensional stability. It is preferred to use poly(ethyleneterephthalate) films with a thickness between 40 and 300 μm as the temporary support for the intermediate photographic member to be used in a method according to the present invention. Most preferably poly(ethyleneterephthalate) films with a thickness between 50 and 100 μm are used. It is possible to use unsubbed polymeric films as temporary support.

In order to regulate the force necessary to strip said temporary support away, once that an intermediate photographic element according to the present invention is transferred to the final glass support, a stripping layer can be applied between said temporary support and said hydrophilic colloid layer(s) of the intermediate photographic member.

Said stripping layer may be composed as disclosed in e.g. U.S. Pat. No. 4,482,625 and EP-A 529697, on the condition that no traces of said stripping layer remain on the photographic material after stripping said temporary support away. A stripping layer for use in an intermediate photographic element according to the present invention comprises preferably either an hydroxyalkylcellulose compound in which alkyl is a C1 to C6 alkylgroup and/or a polyvinylalcohol/polyvinylacetate mixture. The thickness of said stripping layer is in the range of 0.1 to 4 μm, preferably in the range between 0.5 and 2 μm.

The Lamination

The lamination preferably proceeds in a laminator that offers the possibility to adjust the temperature of the lamination rollers. Such a laminator is e.g. OLP70 OXAZOL (trade name) of Hoechst AG, Frankfurt, Germany. It is preferred that the lamination rollers have a temperature between 40° and 150° C., more preferably between 60° and 120° C. The pressure of the lamination rollers is preferably adjusted to a value between 100 N/m and 1000 N/m for rollers having a shore hardness between 15 and 90 Shore A.

It may be beneficial when the lamination can proceed in conditioned atmosphere; when the atmosphere is conditioned it is preferred to keep the temperature between 20° and 30° C. and the relative humidity between 50 and 99%, preferably between 75 and 95%.

The lamination can proceed at any speed, it has been found that a good compromise between economics (speed) and lamination quality could be reached when the speed is between 0.1 and 5 m/min.

The naked glass support on which is laminated can be any glass of any chemical composition and of any flatness, from float glass to optical flat glass. For the purpose of making colour filters for LCD's, it is preferred to use glass of high flatness.

The naked glass support can be cut sheets or even a continuous web of very thin glass. When thinner glass (thickness<1.2 mm) is used having an elasticity modulus (Young's modulus) equal or lower than $7.10^{10}$ Pa and a failure stress equal to or higher than $1.10^{7}$ Pa, the glass support can be a continuous web unwound from a roll.

In the case the intermediate member is a photographic member, lamination can proceed after exposure and processing of said photographic member on a temporary support or the lamination can proceed in the absence of actinic light before exposure and the exposure and processing occur after the lamination of the photographic layers on the glass support.

EXAMPLES

All formulas are given after the description of the various layers comprised in the material.

Following layers were coated in the order given on an unsubbed poly(ethyleneterphthalate) film with thickness 60 μm. So a colour photographic material on a temporary support was formed. In the laminating examples hereinafter, this colour photographic material is indicated by COLMAT

Red Sensitive Layer

A silver chloride-bromide (90/10 molar ratio) emulsion with an average grain size of 0.12 μm was sensitized to red light with a spectral sensitizing agent of formula SR. A cyan dye forming coupler of formula Cl was added to this emulsion. The amounts of silver halide, gelatin and colour coupler Cl were 0.49, 4.5 and 0.95 g/m$^2$ respectively.

First Intermediate Layer

A substance of formula SD, capable of scavenging oxidized colour developing agent was dispersed in gelatin and coated at a coverage of 0.08 g SD/m$^2$ and of 0.77 g gelatine/m$^2$.

Green Sensitive Layer

A silver chloride-bromide (90/10 molar ratio) emulsion with an average grain size of 0.12 μm was sensitized to green light with a spectral sensitizing agent of formula SG. A magenta dye forming coupler of formula M1 was added to this emulsion. The amounts of silver halide, gelatin and colour coupler M1 were 0.71, 2.8 and 0.53 g/m$^2$ respectively.

Second Intermediate Layer

This layer has the same composition as the first intermediate layer.

Blue Sensitive Layer

A 100% silver chloride emulsion with an average grain size of 0.4 μm was sensitized to blue light with a spectral sensitizing agent of formula SB. A yellow dye forming coupler of formula Y1 was added to this emulsion.

The amounts of silver halide, gelatine and colour coupler Y1 were 0.57, 3.30 and 1.0 g/m$^2$ respectively.

Anti-Halation Layer

A non-diffusing yellow dye of formula YD, was dispersed in gelatin. The coverages of yellow dye YD and gelatin were 0.5 and 1.5 g/m$^2$ respectively.

Yellow, magenta and cyan water-soluble dyes, acting as accutance dyes were present at an appropriate coverage in the blue, green en red sensitive layer respectively and hydroxytrichlorotriazine acting as hardening agent was present in the red sensitive layer at a coverage of 0.035 g/m$^2$.

In the following Table 1 the silver halide to colour coupler ratio in equivalent amounts is given for the three light-sensitive layers of the material. The coverages of the colour couplers, expressed in mmoles/m$^2$, are also given.

TABLE 1

| | Silver halide/colour coupler (eq.) | mmol colour coupler/m$^2$ |
|---|---|---|
| Blue sens. layer | 1.2 | 1.4 |
| Green sens. layer | 1.2 | 0.9 |
| Red sens. layer | 1.3 | 1.1 |

CHEMICAL FORMULAS

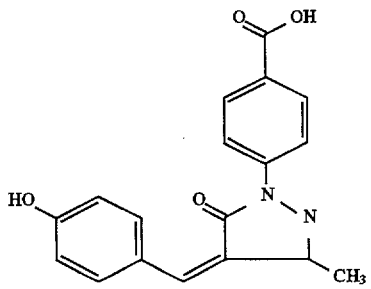

YD

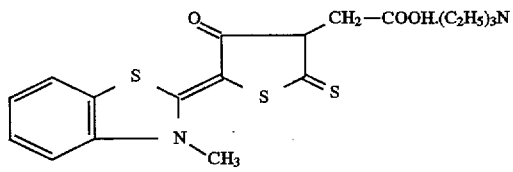

SB

-continued
CHEMICAL FORMULAS
Y1
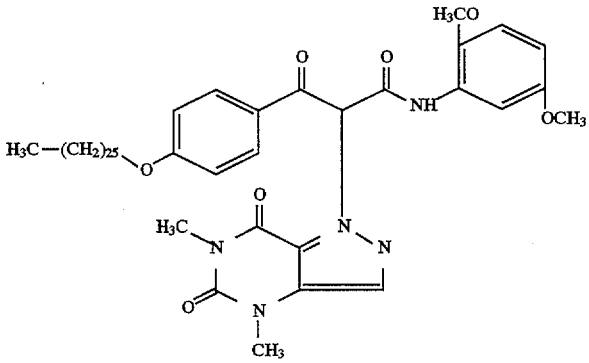
SD
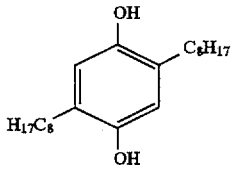
SG
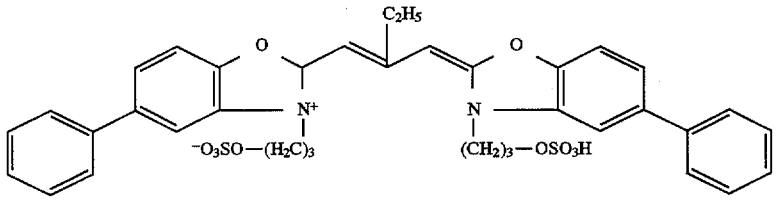
M1
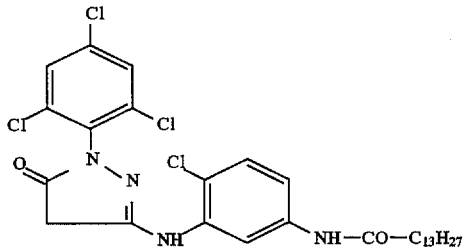
SR
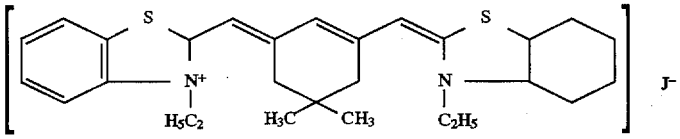
C1
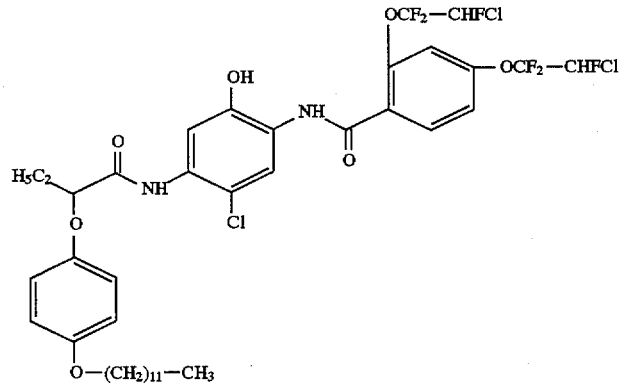
LAMINATION EXAMPLES 1 TO 3
A naked glass support (sodalime glass) with thickness of 1.2 mm was wetted with demineralized water, without any additive and COLMAT was laminated onto the wetted glass support in a laminator (OLP70 OXAZOL (trade name) of Hoechst AG, Frankfurt, Germany) at a speed of 0.34 m/min. The temperature of the laminating roller was changed:

Lamination example 1 (LAM 1): 60° C.

Lamination example 2 (LAM 2): 100° C.

Lamination example 3 (LAM 3): 120° C.

Two different materials COLMAT were used: COLMAT1, freshly coated and COLMAT2, aged for two weeks.

Immediatly after lamination the temporary support was stripped away and the lamination quality was visually judged and given values from 1 to 5, wherein the figures have the meaning:

1 no defects 2 very low amount of defects (some very small air bubbles or pits only visible under microscope)

3 good 4 acceptable 5 bad.

The results are tabulated in table 2.

TABLE 2

| | Lamination quality at different temperatures | | |
|---|---|---|---|
| Material | 60° C. | 100° C. | 120° C. |
| COLMAT1 | 4 | 3 | 3 |
| COLMAT2 | 5 | 4 | 3 |

LAMINATION EXAMPLES 4 to 6

A naked glass support (sodalime glass) with thickness of 1.2 mm was wetted with three different mixtures of a 5% solution of

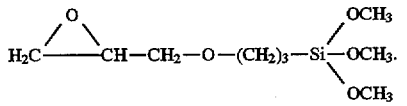

in ethanol (SOL1) and water. The amount of wetting solution was adjusted to have 500 mg of silicon compound per $m^2$. COLMAT1 was laminated to the glass.

The lamination took place as described above, except that the rollers had a temperature of 100° C.

The wetting solutions had following composition (by volume):

Lamination example 4 (LAM 4): 90 parts SOL1/10 parts water

Lamination example 5 (LAM 5): 95 parts SOL1/5 parts water

Lamination example 6 (LAM 6): 99 parts SOL1/1 parts water

The lamination quality was judged As described above. The adhesion in wet condition was determined as follows: the laminated material, of which the temporary support is stripped away is conditioned for 3 days at a temperature of 20° C. at a relative humidity (RH) of 85%. Then the materials were soaked in water, the excess water tapped away and the photographic layers were scratched in cross form. After manually rubbing the place were the two scratches cross, the adhesion was visually judged and given a value from 0 (no part of the photographic layer is rubbed away) to 6 (the photographic layers are totally rubbed away).

In the material, as explained above, AH (Anti-halation) dyes are present, It is important that during lamination no AH dyes are extracted from COLMAT. The degree of extraction of the AH dyes was judged by measuring the optical density of the dyes in COLMAT and then measuring the optical density of the dyes in LAM 4, LAM 5 and LAM 6. The measurement proceeded after a red filter measuring the green AH dye and after a green filter measuring the red AH dye, The difference in density (ΔD) is a measure for the extraction of the dyes.

The results are reported in table 3.

| Example | Lamination quality | Adhesion | ΔD red | ΔD green |
|---|---|---|---|---|
| LAM 4 | 2 | 0 | −0.12 | −0.06 |
| LAM 5 | 2 | 0.5 | −0.06 | −0.01 |
| LAM 6 | 5 | n.m.* | n.m. | n.m. |

*n.m.: could not be measured.

Since a ΔD of 0.10 is a very acceptable figure for loss of AHU, it is clear from the above that the method according to the present invention gives a very good compromise between adhesion and sharpness (low loss of AHU dyes).

We claim:

1. A method for applying a silver halide photographic material with a hydrophilic colloid layer directly on a naked glass support comprising the steps of (i) wetting a naked glass support, with a wetting solution consisting essentially of a polar solvent and water, (ii) applying said silver halide photographic material with a hydrophilic colloid layer, that is provided on a temporary support, onto said wet glass support so that said hydrophilic colloid layer is in direct contact with said wetted glass and (iii) stripping said temporary support away.

2. A method according to claim 1, wherein said wetting solution includes an organic silicon compound.

3. A method according to claim 2, wherein said silicon compound corresponds to the formula

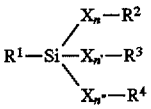

wherein:

X stands for oxygen or —O—CO—, each of $R^1$, $R^2$, $R^3$ and $R^4$, the same or different, stands for a hydrocarbon group selected from the group consisting of alkyl and aryl groups, at least one of said hydrocarbon groups comprising a group selected from the group consisting of epoxy groups, amino groups, amide groups, ester groups and halide groups, and each of n, n' and n", the same or different, stands for 0 or 1, n+n'+n" being at least equal to 1.

4. A method according to claim 3, wherein n+n'+n"=3 and $R^1$ comprises a group selected from the group consisting of epoxy groups; amino groups, amide groups, ester groups and halide groups.

5. A method according to claim 2, wherein said organic silicon compound comprises an epoxy group.

6. A method according to claim 5, wherein said organic silicon compound has the formula

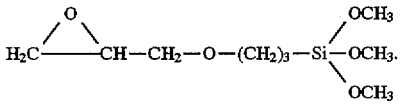

7. A method according to claim 1, wherein said wetting solution comprises between 80 and 98% by volume of ethanol and between 20 and 2% by volume of water.

8. A method according to claim 2, wherein said wetting solution comprises between 1 and 10% by weight of said organic silicon compound.

9. A method according to claim 8, wherein said wetting solution is applied to said naked glass support such that between 50 mg and 3 g of organic silicon compound is present per $m^2$.

10. A method according to claim 1, wherein said temporary support is a poly(ethyleneterephthalate) film having a thickness between 40 and 300 μm.

11. A method according to claim 1, wherein said method is implemented at a temperature between 40° and 150° C.

12. A method for applying a hydrophilic colloid layer on a naked glass support comprising three phases:

Phase I, comprising the step of applying a silver halide photographic material with a hydrophilic layer onto a temporary support, forming an intermediate element;

Phase II, comprising the steps of:

(i) wetting a naked glass support with a wetting solution comprising an organic silicon compound that comprises a silicon portion reacting with glass and an organic portion comprising a group selected from the group consisting of epoxy groups, amino groups, amide groups, ester groups and halide groups, (ii) drying said support at temperatures above 50° C., thus giving a pre-treated glass support;

Phase III, comprising the steps of:

(i) wetting said pre-treated glass support, with a wetting solution consisting essentially of a polar solvent and water, (ii) applying said intermediate element onto said wetted glass support with said hydrophilic colloid layer directly to said glass support, forming a complex structure, (iii) stripping said temporary support away.

* * * * *